United States Patent [19]

Dalla Vecchia

[11] 3,977,580

[45] Aug. 31, 1976

[54] APPARATUS FOR TURNING A TUBULAR FABRIC INSIDE OUT

[75] Inventor: Gino Dalla Vecchia, Santorso (Vicenza), Italy

[73] Assignee: Giuseppe Sperotto S.p.A., Zene' (Vicenza), Italy

[22] Filed: Dec. 16, 1975

[21] Appl. No.: 641,160

[30] Foreign Application Priority Data

Dec. 19, 1974 Italy ..... 30766/74

[52] U.S. Cl. ..... 223/43

[51] Int. Cl.[2] ..... A41H 43/00

[58] Field of Search ..... 223/39–43; 15/304; 302/2 R, 2 A, 21

[56] References Cited

UNITED STATES PATENTS

| | | | |
|---|---|---|---|
| 3,429,618 | 2/1969 | Sparso et al. | 223/43 X |
| 3,568,898 | 3/1971 | Griffin | 223/43 |
| 3,892,341 | 7/1975 | Goodson | 223/43 |
| 3,941,285 | 3/1976 | Bailey | 223/43 |

*Primary Examiner*—G. V. Larkin

*Attorney, Agent, or Firm*—Karl W. Flocks

[57] ABSTRACT

A machine is disclosed for turning inside out a tubular fabric (e.g. stockings), which comprises a fabric-container, a tube for turning the fabric inside out, said tube overhangingly extending from the container, an air-drawing and blowing unit for blowing air into and drawing air from said tube, air-stream deflecting means to cause the blown air-stream to be deflected towards the outside face of the tube and valve means. The mechanical structure is simplified over that of the devices of the prior art and the operation becomes continuous instead of being intermittent. Manual manipulations are virtually suppressed.

4 Claims, 6 Drawing Figures

IV
29
36
37
12
25
10
26
28
27
24
23
III
18
15
16
13
19
20
21
22
II
29a
12a
20a
24a
21a

APPARATUS FOR TURNING A TUBULAR FABRIC INSIDE OUT

As is well known to those skilled in the art, to carry out finishing operations, such as dyeing and washing of a tubular fabric, implies the turning inside out of the latter, so that the right side of the fabric is inside and the reverse outside.

This is so, because, otherwise, the right side of the fabric would become fluffy due to the prolonged and vigorous rubbing action imparted thereto by the members (rolls, spindles, fluid jets and the like) which drag and treat a fabric strip, for example united together at the ends so as to make up a closed loop, through the processing machinery which is operated at comparatively high a speed.

This defect, which is called "pilling" and is more or less serious consistently with the quality and class of the yarn used, cannot be accepted since it impairs the fabric quality, by pushing back the fabric to the second and even third class, the result being an economical loss.

Machines have already been suggested in order automatically to perform the turning operation of a tubular fabric. These machines generally comprise a long tube on which the fabric to be turned inside out is manually slipped. A strong air stream is then blown in the interior of the tube so as to catch a short end portion of the fabric as properly slipped onto the end of the tube on which the fabric has been slipped. As a result, the fabric is dragged and is turned inside out in the tube interior.

Machines of this kind, however, have proven to be unsatisfactory in operation, especially due to the comparatively important manual manipulation which was still required of the operator for slipping the fabric over the tube. In addition, the tube must have the same length as the fabric to be turned inside out, that which involves a considerable bulk if very long tubes are used, as well as a great discontinuity in processing if very short tubes are conversely used. As a matter of fact, on completion of each working cycle, the blowing mechanism should be withdrawn from the tube mouth, the fabric should be slipped over the tube and the blowing mechanism brought into the working position again. All these steps are carried out manually and make the production abnormously discontinuous.

An object of the present invention is thus to provide a machine the manufacture of which is cheap and the operation reliable and safe and which is capable of turning inside out tubular fabrics in a completely automatic and continuous way so as considerably to abate the present first costs of a tubular fabric.

This object is achieved according to the present invention by a machine which is characterized in that it comprises, in combination: at least a collecting container for the fabric turned inside out, at least a fabric-turning tube overhangingly extending from said container and directly communicating therewith, a blowing and exhausting unit for alternately blowing air into and sucking air from the tube, baffling means at the free tube end which are capable of deflecting an air stream as blown in a direction opposite to the original blowing direction onto the outer surface of the tube, and valve means adapted automatically to open and close the free tube end, respectively, when air is drawn and blown therethrough.

By so doing, an end portion of a tubular fabric, which can be wound with advantage in tape form on a spool, is first slipped onto the tube by an air stream blown therethrough and deflected over its outer surface, and then dragged so as to be turned inside out in the interior of the tube by the agency of an air stream drawn into the collecting container through the tube.

The accompanying drawings show an exemplary embodiment of the invention, without limiting same.

Figures 1, 4:
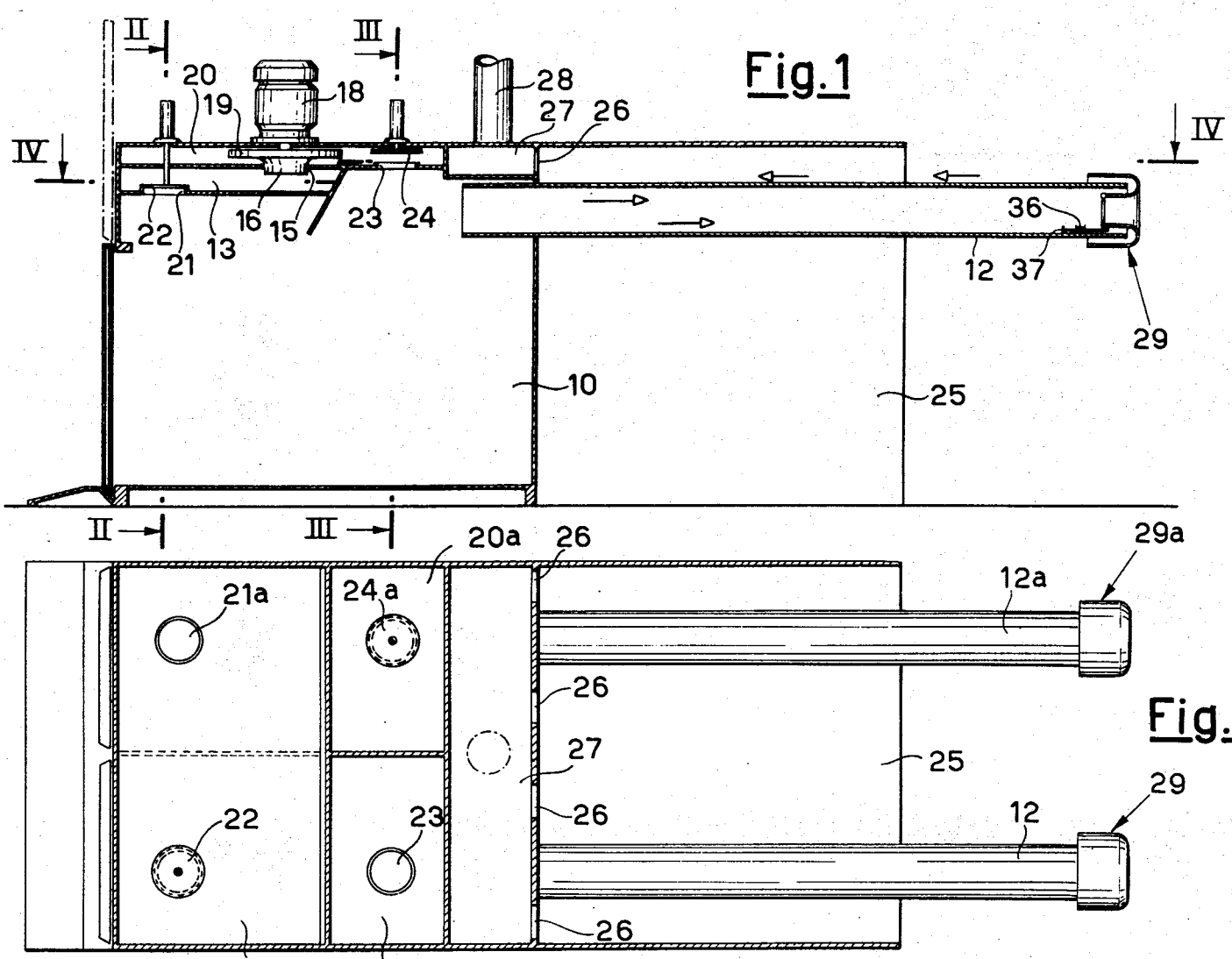
FIG. 1 is a longitudinal vertical cross-sectional view of the machine, taken along the line I—I of FIG. 2.
FIG. 4 is a cross-sectional view, taken along the line IV—IV of FIG. 1, and FIGS. 5 and 6 are close up views showing the operative principle of the machine.
Figure 3:
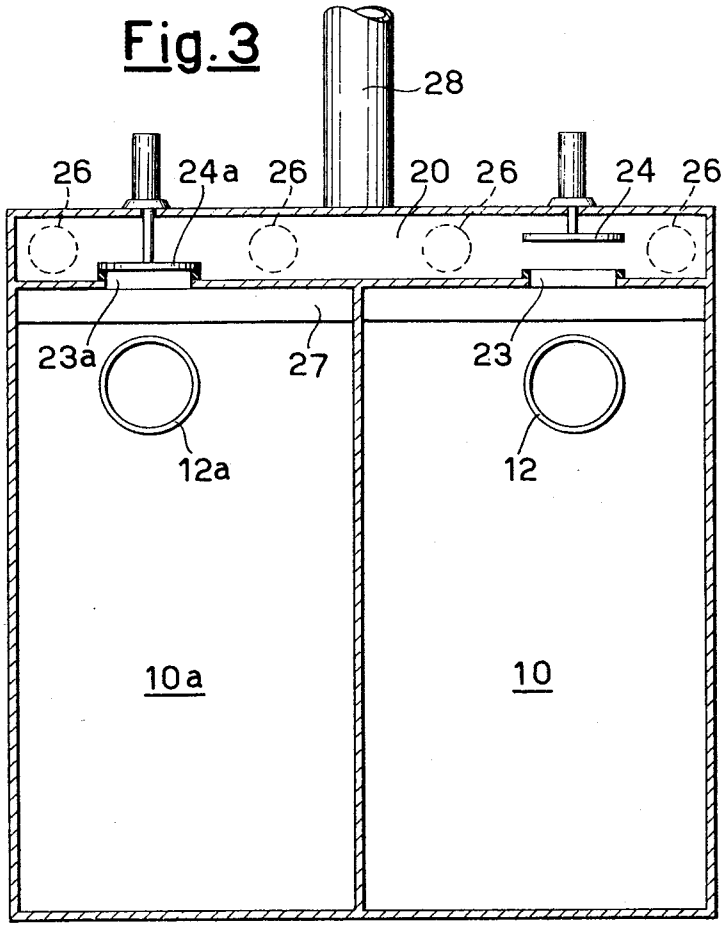
FIG. 3 is a cross-sectional view taken along the line III—III of FIG. 1.
Figure 2:
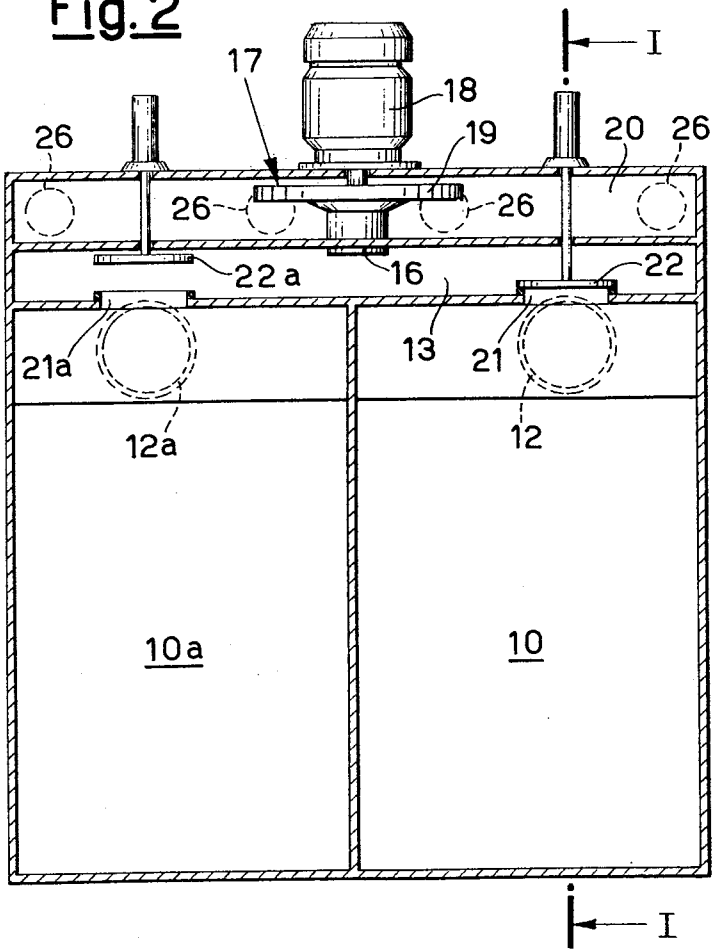
FIG. 2 is a cross-sectional view taken along the line II—II of FIG. 1.

The machine according to the invention, in a preferred embodiment, is structurally made up by two discrete containers 10, 10*a*, for collecting the fabric turned inside out, from which overhangingly extend the respective turning tubes 12, 12*a*.

Above the containers 10, 10*a* there is a chamber 13 to which is connected, via a port 15, the suction side of a centrifugal blower 17 driven by a motor 18 and having the delivery side 19 within a chamber 20 overlying the chamber 13.

The containers 10, 10*a* communicate with the chamber 13 via ports 21, 21*a*, respectively, as controlled by the attendant valves 22, 22*a*. The chamber 20, in its turn, communicates with the containers 10, 10*a*, respectively, through ports 23, 23*a* as controlled by their respective valves 24, 24*a*.

The tubes 12, 12*a* are partially contained within an air-conveying tunnel 25, which, via holes 26, communicates with an air manifold 27, the latter discharging through a duct 28. The air from the duct 28 can be discharged into the atmosphere, or recycled.

At their free ends, the tubes 12, 12*a* are equipped with respective valve units and baffles as generally indicated at 29, 29*a*.

The ensuing description, in order to simplify the disclosure, refers to one only of these units.

Each valve and baffle unit comprises an annular piece as made up by two walls 30 and 31 which are spaced apart and radiussed at 32 to provide an annular channel 33, the latter being slipped by way of a plug onto the edge of the free end of the relevant tube 12, 12*a*.

Figure 5:
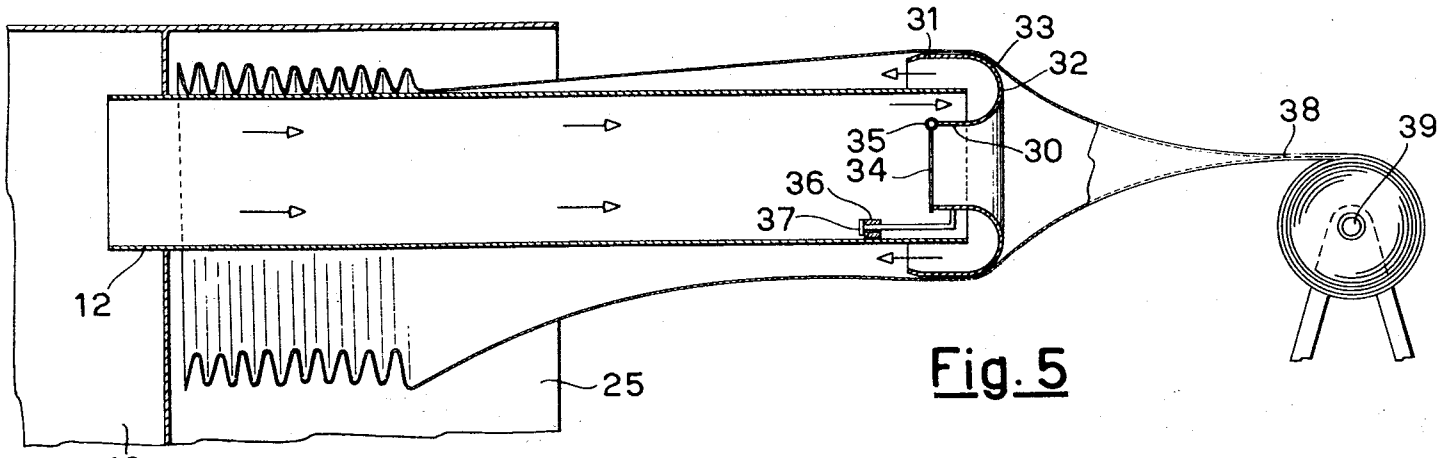
Figure 6:
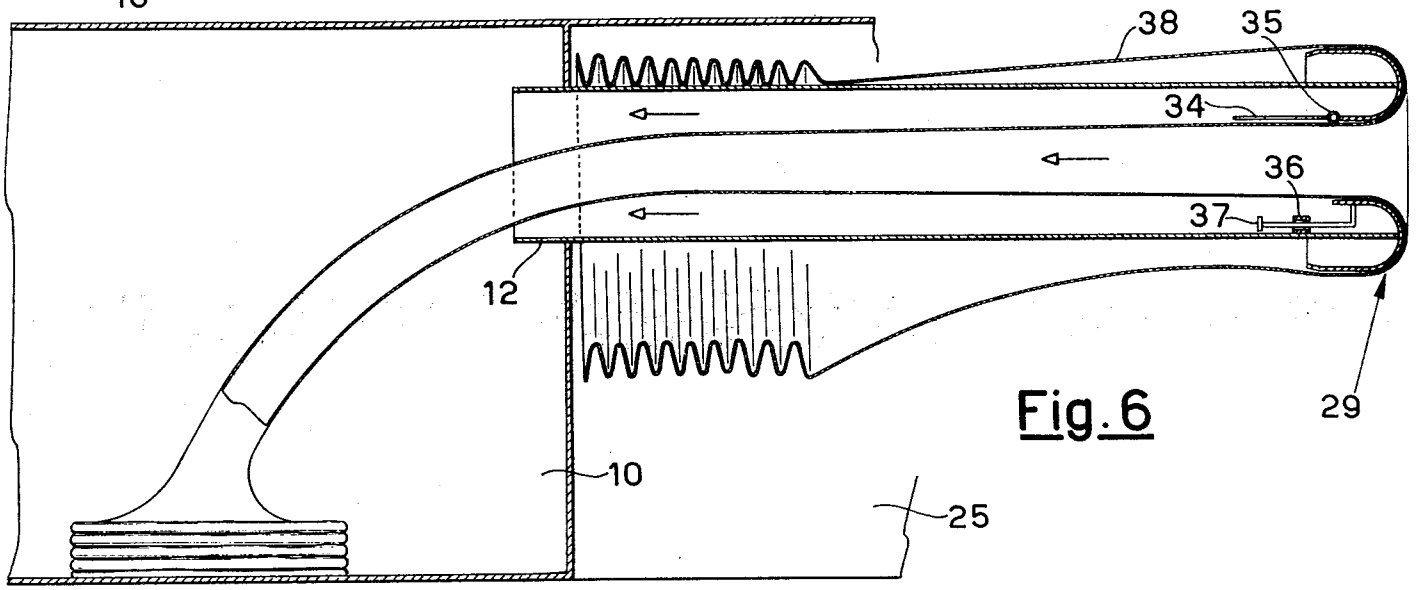

The opening of the unit is controlled by a flap valve 34, which is normally closed, and is hinged at 35. The unit is moreover mounted at the tube mouth in a sliding manner between the two end positions as shown in FIGS. 5 and 6 of the drawings. To this end, guides symbolized at 36 and an abutment 37 are provided to prevent the unit from being freely removed from the tube.

The assembly as described above can operate in the two following different ways: either by using the individual tubes 12, 12*a* as discrete units, or by using them concurrently but phase-shifted, that is to say, by having them alternately carrying out the two discrete stages which make up the working cycle for turning inside out a tubular fabric.

Assuming that the machine is used in the former way, an end portion of a tubular fabric 38, preferably wrapped in the form of a flattened out tape on a rotatable spool 39, is manually slipped over either tube, such as 12. At this stage, with the valves 22 and 24 closed and open, respectively, the blower 17 is actuated and draws air from the chamber 13 and blows same through the tube 12 along the route which comprises the chamber 20, the port 23 and the container 10. As a result, the air stream, as it encounters the valve 34 closed, pushes the unit 29 towards the position of FIG. 5, so that the same air stream is led to follow the channel 33 and is thereby deflected in the opposite direction to flow over the outer surface of the tube 12 on which the tubular fabric had previously been slipped. Thus, the fabric is caught by the air stream and is dragged to be slipped onto the tube as shown in FIG. 5. As soon as the entire fabric roll has been slipped onto the tube, the position of the valves 22 and 24 is reversed and these are now open and closed, respectively. Consequently, the blower draws air directly from the tube 12 into the container 10, through the port 21 and the chamber 13. The unit 29 is thus shifted to the position of FIG. 6, the valve 34 being open, and the fabric is dragged into the interior of the tube, so as to be turned inside out in the manner as clearly shown in the drawing.

Assuming now that it is desired to use the machine in the second way as mentioned above, after having slipped, in the manner as described above, a fabric onto the tube 12, another fabric is slipped over the tube 12*a*. It is now apparent that with the valves 22 and 24 open and closed, respectively, and with the valves 22*a* and 24*a*, also closed and open, respectively, while the fabric which had already been slipped over the tube 12 is turned inside out by the air drawn by the blower, the other fabric, just now slipped over the tube 12*a*, is fully slipped over the latter tube by the air as blown by the same blower. The position of the four valves is then switched and the cycle is reversed so as to have the two tubes 12, 12*a* simultaneously and continuously operative, but phase-shifted.

While a preferred embodiment of the invention has been shown and described, be it understood that modifications and changes can be introduced therein without thereby departing from the scope of the invention as defined in and by the appended claims. For example, a machine could be constructed with a single collecting container for the fabric and a single fabric-turning tube, without any changes but a conceptual one.

What I claim is:

1. A pneumatic machine for turning tubular fabrics inside out, characterized by comprising, in combination: at least a collecting container for the fabric as turned inside out, at least a fabric-turning tube overhangingly extending from said container and directly communicating therewith, an exhausting and blowing unit for alternately drawing and blowing air through said tube, baffling means at the free end of said tube and capable of deflecting a blown air stream in a direction opposite to that of blowing onto the outer surface of the tube, and valve means adapted automatically to open and close the free tube end respectively when air is drawn and blow therethrough.

2. A machine according to claim 1, characterized in that said baffling means and said valve means are all integral part of a single valving and baffling unit comprising a flap valve which is closed in the direction of air blow through the tube and hinged at a point of the inner circumference of an annular member as made up by two spaced apart and radiussed walls to provide an annular channel adapted to be slipped over the free end of the tube, said annular member being shiftable by the blow airstream and the drawn airstream between two end positions, a first position where the radius of connection of the two walls is spaced apart from the edge of the free tube end, and a second position where said connecting radius abuts said tube edge.

3. A machine according to claim 1, characterized in that said exhausting and blowing unit is a centrifugal blower the suction side of which is connected to a suction chamber for air capable of being put in communication with the container through a valve-controlled opening, and the delivery side of which is housed within a delivery chamber which is also capable of being put in communication with the container through an opening as controlled by a valve.

4. A machine for turning a tubular fabric inside out characterized in that it comprises: two adjoining fabric-collecting chambers from which overhangingly extend fabric-turning tubes in direct communication with the relevant chambers, an unit which alternately draws and blows air through said tubes, baffling means at the free ends of each tube and capable of deflecting an air stream as blown in a direction opposite to the blowing direction over the outer surface of the tube, and valve means adapted to open and close automatically the free end when air is drawn and blown therethrough, respectively.

* * * * *